United States Patent [19]

Payen et al.

[11] Patent Number: 4,653,343

[45] Date of Patent: Mar. 31, 1987

[54] PROGRAMMER

[75] Inventors: Jean-Noël Payen, Araches; Francis Thomas, Cluses, both of France

[73] Assignee: Carpano & Pons, France

[21] Appl. No.: 691,275

[22] Filed: Jan. 14, 1985

[30] Foreign Application Priority Data

Jan. 18, 1984 [FR] France ..... 84 01226

[51] Int. Cl.[4] ..... H01H 7/08; H01H 43/10

[52] U.S. Cl. ..... 74/568 T; 200/38 A

[58] Field of Search ..... 200/37 A, 38 A, 38 B, 200/38 C, 38 D, 38 DA; 74/3.52, 122, 125, 568 T, 625

[56] References Cited

U.S. PATENT DOCUMENTS

| | | | |
|---|---|---|---|
| 2,913,913 | 11/1959 | Weber | 74/125 |
| 3,967,078 | 6/1976 | Yaguinuma | 200/38 A |
| 4,566,347 | 1/1986 | Thomas | 74/125 |

FOREIGN PATENT DOCUMENTS

| | | | |
|---|---|---|---|
| 2655540 | 6/1977 | Fed. Rep. of Germany | 74/568 T |
| 2271609 | 12/1975 | France . | |

*Primary Examiner*—Lawrence Staab

*Attorney, Agent, or Firm*—Darby & Darby

[57] ABSTRACT

This programmer comprises programme-cams corresponding to a plurality of programmes having clearly separate starting points disposed at angular intervals from one another. It further comprises a control element adapted to be rotated manually for selecting the initial position of one of the programmes. This element comprises lateral pins adapted to engage corresponding orifices formed in a coaxial registering control cam. On the opposite side of this cam a disc rigid with the programme-cams is provided; this disc is rigid with the programme-cams but spaced therefrom. The disc comprises ramp means cooperating with bearing faces formed in the control cam. Spring means interconnect the disc and the control cam in diagonal directions. The ramp means and their bearing faces are so oriented that when the control element is driven manually in the forward direction the control cam rotatably driven by the pins is shifted axially away from the manual control element by the ramp means with the assistance of spring means until the beak of an arm is actuated for controlling a switch adapted to control the fast rotation of the disc. When the disc is thus driven automatically for step by step rotation at a fast rate its ramp means cause the control cam to be shifted towards the control element, the pins engaging again the corresponding orifices until the beak is actuated again, the switch being thus actuated for stopping the fast rotation of the disc and programme-cams for ending the programme selection.

6 Claims, 11 Drawing Figures

PROGRAMMER

BACKGROUND OF THE INVENTION

The present invention relates to a programmer in which programme-cams comprising several programmes having their starting points spaced angularly from each other are adapted to be driven automatically with a step by step motion. A manually operated control element is provided for selecting the initial angular position of anyone of the programmes contemplated and cooperates with a control cam disposed coaxially in front of this control element. Means are provided for shifting the control cam axially between two end positions and, in the second position, actuating at least one switch controlling the automatic and fast step by step rotation of the programme-cams. Means for automatically and rotatably driving the control element from the control cam are adapted to become operative in the first axial position of the control cam. A spring-loaded positioning pawl is provided for engagement with teeth formed on the manual control element.

THE PRIOR ART

In known programmers of this type, such as the one disclosed in the French Patent No. 2,271,609, ramp means are provided on the control element and/or the control cam and adapted, when the control element is rotated manually for selecting a predetermined programme, to shift the control cam axially toward its second position in which the cam actuates the switch controlling the automatic fast step by step rotation of the programme-cams. When the programme-cams subsequently catch up angularly, at a fast speed, the manual control element, the same ramp means operate in the opposite direction and act as guide means to permit another axial movement of the control cam toward its first inoperative position. This axial movement is slow due to the ramp profile, and at this time the switch is not actuated again by the control cam for stopping the fast rotation of the programme-cams. To come to the beginning of the selected programme, the control cam must in fact cover at fast speed an angle b and during this movement the cam contour must be such as to actuate the switch control lever controlling in turn the stoppage of the fast rotation of the programme-cams, control cam and manual control element.

This arrangement is attended by the inconvenience that it is impossible, from a predetermined angular stop position of the programme-cams and of the manual control element, to select a programme starting just one "step" after this stop position. In fact, each "step" has a relatively small angular value, as a rule of the order of 6 degrees, so that the highest possible number of steps are available for a complete rotation of the programme-cams. Below a six-degree step, it is in fact difficult to control electric contacts with a complete safety. Now the inclination of the ramp means provided for producing the axial shifting of the control cam must be limited to permit a relatively easy manual actuation of the control element for rotating same. Thus, for instance, a rotation of at least five degrees of the control element is necessary for causing the ramp means to shift the control cam axially to its second position, and consequently the same angle is required for causing this cam to move back for positively engaging the manual control element, by following said ramp means. On the other hand, for moving the programme-cams to the initial position of the selected programme these programme-cams must be further rotated through angle b which for example corresponds to at least four degrees. It will be seen that the total angle (a+b) through which the programme-cams must be rotated for attaining the initial position of a selected programme is greater than 6° which is the angular value of one step. During the following slow start of the programme-cams, for the normal development of the selected programme the programme-cams terminate the begun additional step which is therefore unused for the programme proper.

SUMMARY OF THE INVENTION

The programme according to the present invention comprises a disc rigidly coupled to the programme-cams and disposed coaxially to the control cam on the side thereof opposite the manual control element, said disc and control cam comprising means adapted to shift said control cam axially between its two end positions. The manual control element and the control cam comprise the one at least one pin extending laterally toward the other, and the other a transverse orifice adapted to be engaged by said pin when the control cam is in its first inoperative position. The gap left between the disc and the manual control element is sufficient to enable the control cam to assume its second axial or operative position in which the lateral pin is retracted from the transverse orifice. The element comprising this orifice is so designed that the tip of the pin can slide on its radial face when the control cam is in this second axial position. The control cam has a constant profile throughout its peripheral contour so that it can actuate the switch instantaneously irrespective of the angular position of the cam. The teeth formed on the manual control element correspond to predetermined selecting positions, and the force exerted by the spring-loaded pawl on said teeth is sufficient for preventing the forward rotation of the manual control element during the fast automatic rotation of the disc and programme-cams which is necessary for restoring the control cam to its first inoperative axial position.

It is the primary object of the present invention to provide means for constructing a programmer of this type which, while preserving the advantageous features of the prior art mechanisms, provides the additional and advantageous feature of permitting the selection of a predetermined programme by causing the programme-cams to rotate through an angle having an amplitude of less than one "step". Therefore of relatively reduced angular value of the order of, say, six degrees, irrespective of the angular position of the stopped programme-cams which existed before a new selection was made, whether this preceding angular position corresponds or not to a programme start selecting position, the manual effort necessary for making this selection increasing advantageously gradually until it becomes eventually zero at the end of the manual selection. Additional advantageous features are provided by several variations to be described in the following description of preferred forms of embodiment of the invention.

THE DRAWINGS

DESCRIPTION OF THE PREFERRED EMBODIMENTS

Figure 1:
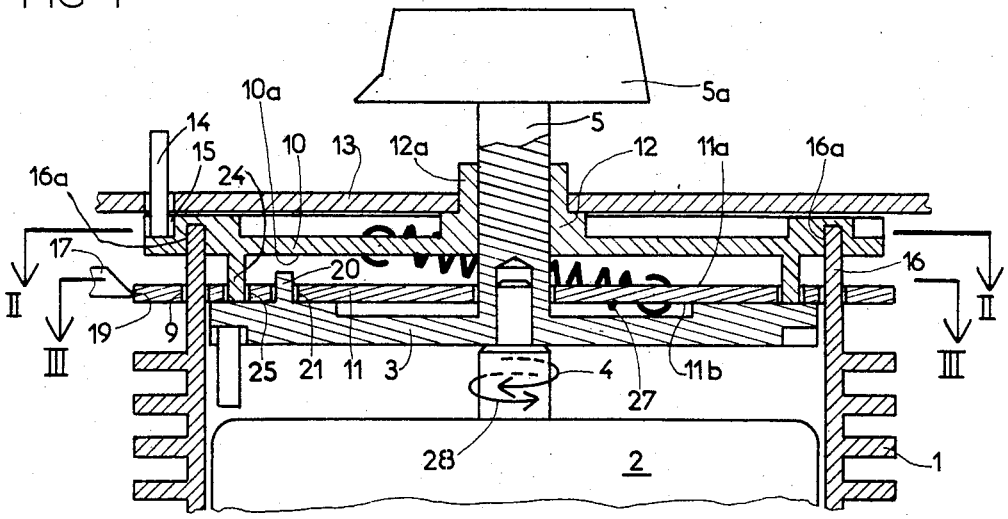
FIG. 1 is a fragmentary section taken along the broken line I—I of FIG. 3, both Figures showing a first form of embodiment of the invention.
Figure 2:
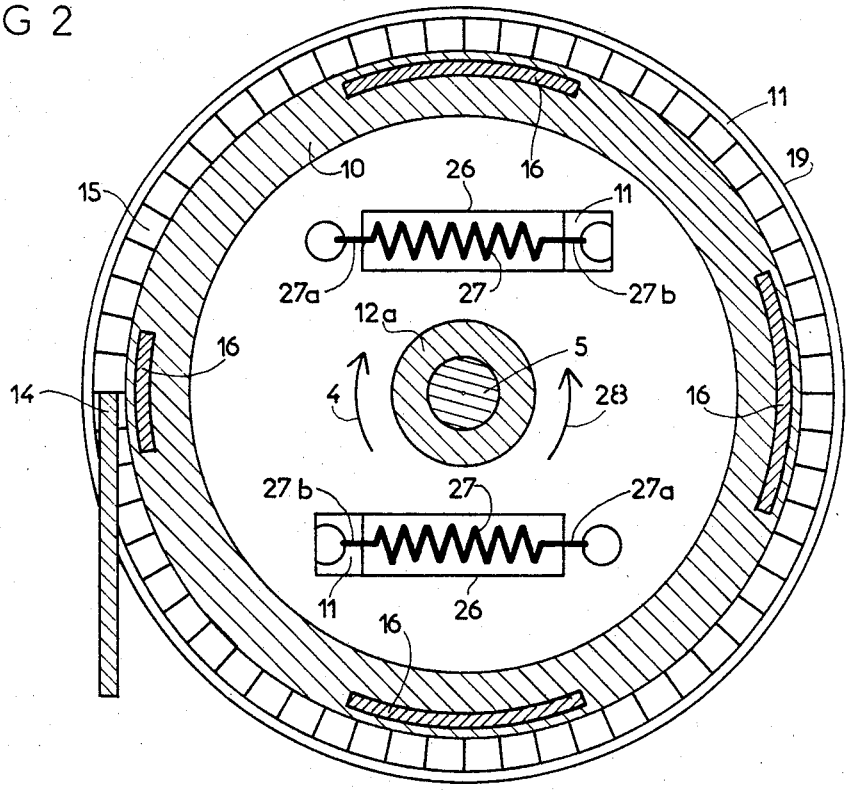
FIG. 2 is another section taken along the line II—II of FIG. 1.
Figure 3:
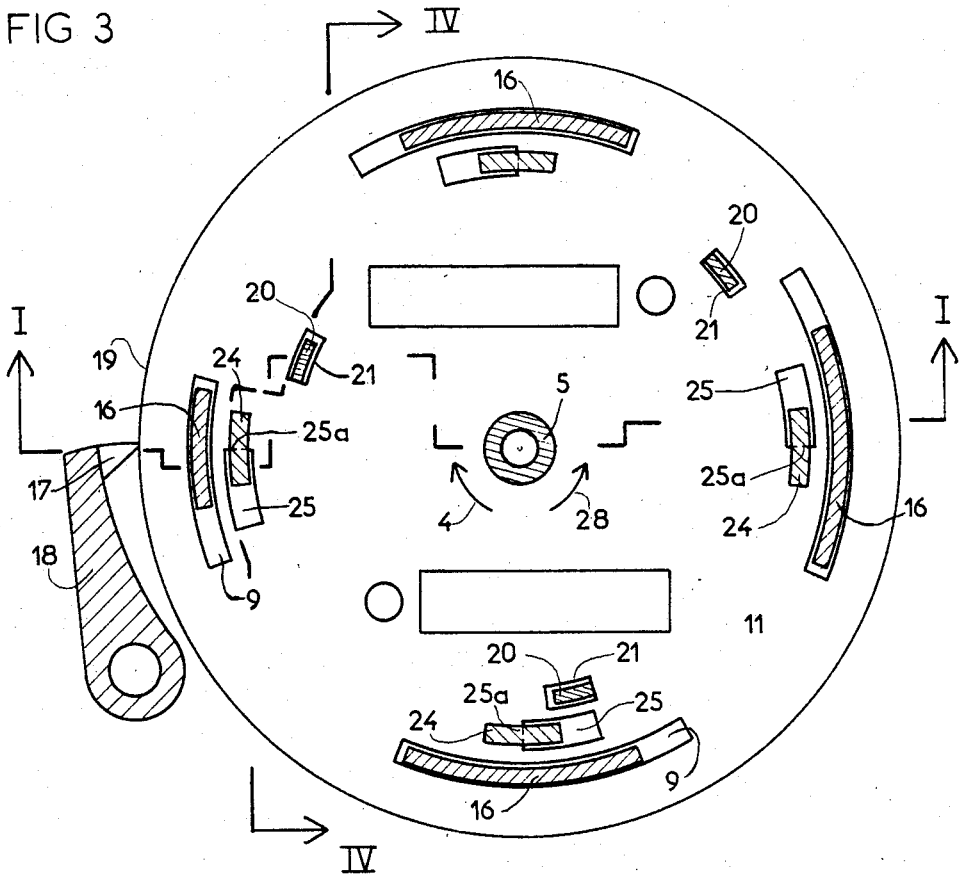
FIG. 3 is a section taken along the line III—III of FIG. 1.

As illustrated in FIGS. 1–8 of the drawings the programmer according to the present invention comprises programme-cams 1 for several programmes having separate starting points spaced angularly from one another. These programme-cams 1 are adapted to be driven automatically for step by step rotation by means of a small motor 2 through a reduction gearing and a step by step feed device (not shown). The programme-cams 1 actuate switch means (not shown) adapted to control the various component elements of an electrical apparatus or machine, for example a household machine.

A control element 3 is actuatable manually for rotation in the direction of the arrow 4 by means of an external drive shaft 5 incorporated in this manual control element 3 and provided with a hand knob 5*a* for selecting the initial angular starting position of anyone of the programmes contemplated, more generally a STOP position corresponding to the end of the programmes. This manual control element comprises on its outer periphery gullet teeth projecting for example radially and upwardly. In FIGS. 4 to 8, the visible teeth 6*b*,6*c*,6*d* correspond to selecting positions of some of the programmes contemplated, respectively, tooth 6*a* corresponding for example to the STOP position at the end of the programmes. A first positioning pawl 7 urged by a spring 8 normally engages the teeth 6 of the manual control element 3. In a manner to be explained more in detail presently this manual control element 3 is adapted to cooperate with a concentric and coaxial control cam 11. In this example the control cam 11 is adapted to pivot about the control shaft 5.

A disc 10 rigid with the programme-cams 1 is disposed coaxially to control cam 11 on the top face 11*a* of this cam, that is, opposite the manual control element 3. In this example, the disc 10 is axially spaced from said programme-cams 1 and rigid with a hub 12 encircling the external control shaft 5. This hub 12 comprises an upper portion of reduced diameter 12*a* pivotally mounted in a fixed top plate 13. This hub 12 consisting for example of thermoplastic material constitutes in this assembly a bearing for said shaft 5. Its upper portion 12*a* of reduced diameter projects above the level of plate 13 around shaft 5 and externally of the programmer mechanism. In this arrangement, the disc 10 comprises on its outer periphery radial gullet teeth 15 equal in number to the number of "steps" contemplated, these teeth 15 being adapted to be engaged by a second spring-loaded pawl 14. The gullet teeth 15 are directed to permit the rotation of the disc in the direction of the arrow 4, that is, in the same direction as the manual control element 3.

In this example the disc 10 is normally urged away from the programme-cams 1 by four arcuate ribs 16 rigid with the programme-cams 1, the upper ends of these ribs 16 being received and retained in corresponding arcuate slots 16*a* (FIG. 1) formed in disc 10. The control cam 11 comprises arcuate apertures 9 (FIGS. 1–3) dimensioned to permit the passage of said ribs 16 and a certain angular movement, in excess of 5° in this example, of said cam 11 in relation to ribs 16. The disc 10 and control cam 11 are provided with means for shifting said control cam 11 axially between two end positions, that is, a first inoperative position (FIG. 4) in which the cam 11 is urged against the manual control element 3, and a second operative position (FIG. 6) in which the same cam 11 is spaced from the manual control element 3. The control cam 11 has a constant profile 19 throughout its periphery, so that, irrespective of its angular position, it can actuate instantaneously the inclined beak 17 of an arm 18 (by releasing this beak in the present example) which actuates in turn and immediately at least one switch (not shown). This switch advantageously controls the automatic fast step by step rotation of the programme-cams. This actuation takes place when the control cam 11 is approaching its second operative axial position.

Figure 4:
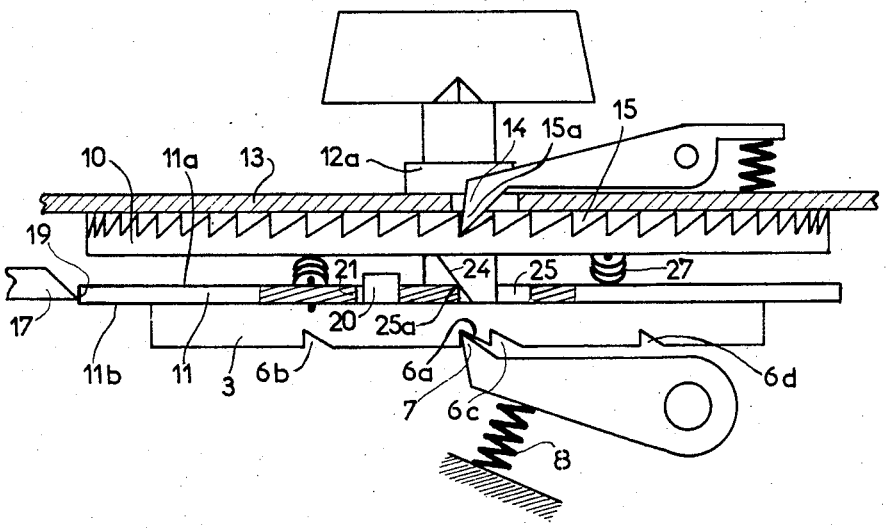
FIGS. 4 to 8 illustrate in section taken along the broken line IV—IV of FIGS. 1 and 3 the same form of embodiment during different stages of its operation.

The manual control element 3 comprises a plurality (three in this example) of pins 20 (FIG. 3) projecting toward the control cam 11 and this control cam 11 comprises three through orifices 21 adapted to receive said pins 20 when the control cam 11 is in its first inoperative axial position (FIG. 4).

The gap left between the disc 10 and the manual control element 3 is sufficient to enable the control cam 11 to move to its second operative axial position (FIG. 6) in which the projecting pins 20 are retracted completely from the corresponding through orifices 21.

The element comprising these orifices 21, namely cam 11 in this example, is so disposed that the tips of pins 20 can slide freely on its radial face 11*b* opposite face 11*a* when the control cam is in its second axial position.

In this example, the gap between disc 10 and programme-cams 1 is sufficient for receiving the control cam 11 and the manual control element 3 and permitting (as mentioned hereinabove) the axial shifting of the control cam 11 between the manual control element 3 and the disc 10.

Figure 6:
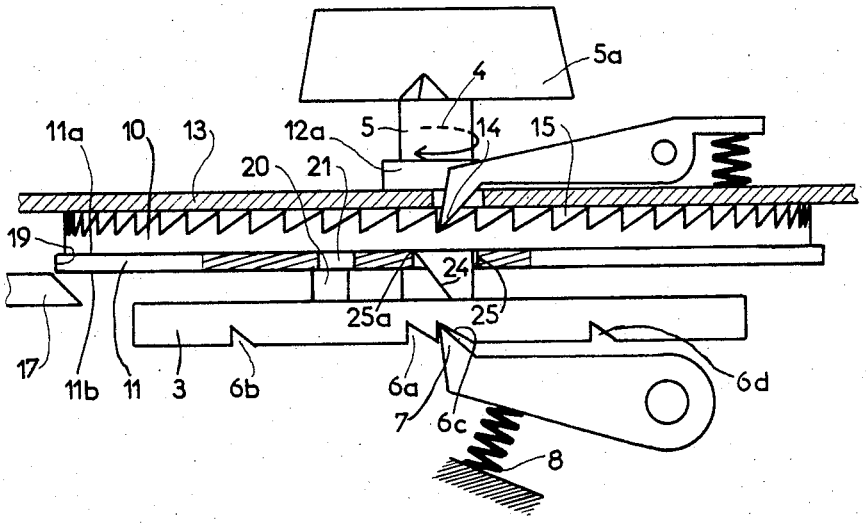

In this first form of embodiment, the means provided for axially shifting the control cam 11 between its two end positions comprise ramp means 24 formed on the radial face 10*a* of disc 10 (FIG. 4) and each adapted to engage a corresponding bearing face formed on the registering radial surface 11*a* of control cam 11. These bearing faces consist for example of one of the edges 25*a* of orifices 25 formed through said control cam 11 and adapted to receive said ramp means 24 completely when said cam 11 is in its second axial position (FIG. 6). The disc 10 further comprise through apertures 26 (FIG. 2) permitting the passage of a pair of springs 27, such as traction springs, disposed on either side of shaft 5, each spring having one end anchored at 27*a* to disc 10 and the other end attached at 27*b* to control cam 11. These springs 27 are so directed as to constantly urge the control cam 11 backwards in the direction of the arrow 28 opposite the arrow 4, in relation to disc 10, and axially toward disc 10 and away from manual control element 3. The ramp means 24 and their bearing faces 25*a* are so oriented and shaped that the springs 27, by rotating the cam 11 backwards, constantly urge this cam towards its first axial inoperative position, that is, towards the manual control element 3.

When the programmer is inoperative, its various component elements are in the positions illustrated in FIGS. 1–4. The programme-cams 1 are held against rotation by the second pawl 14 engaging a tooth 15*a* (FIG. 4) of disc 10. The manual control element 3 is locked against rotation by the spring-loaded pawl 7 engaging the corresponding tooth 6*a*. In this example in the STOP position of the programmecams, at the end of the sequence of programmes contemplated. The pins 20 engage the orifices 21, and control cam 11 is in its first axial inoperative position with its radial face 11*a* pressed against the manual control element 3 by the springs 27 tending to rotate this cam 11 backwards in the direction of the arrow 28 in relation to the ramp means 24 of disc 10 locked against rotation. The beak 17 of arm 18 is kept in its retracted position by control cam 11 and the corresponding switch does not control the fast rotation of programme-cams 1.

Figure 5:
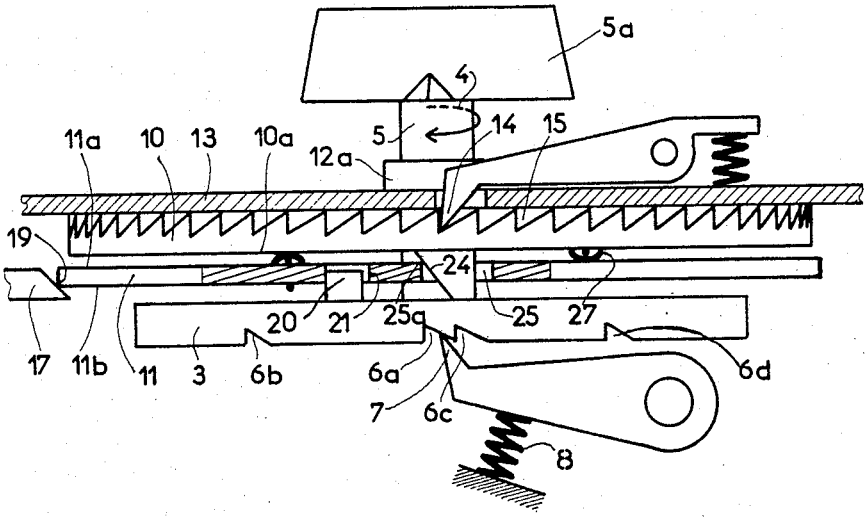

Now let us assume that the operator is desirous to select the programme of which the starting point corresponds to an angular position of the manual control element in which the pawl 7 must engage and lock the tooth 6*c* which is the tooth next to tooth 6*a* and therefore spaced therefrom by the angular distance of one 6-degree "step". The operator rotates the knob 5*a* and consequently the manual control element 3 in the direction of the arrow 4, this control element, through its pins 20, driving the control cam 11 in the same direction. As this rotation takes place, and as illustrated in FIG. 5, due to the tension of springs 27, the bearing faces 25*a* of this cam follow the corresponding ramp means 24 which at this time are fixed, and the control cam 11 moves away from its first axial position towards the disc 10 while gradually releasing the beak 17 of arm 18. The springs 27 are gradually stressed, and at the same time the pawl 7 is pushed back by the inclined side of tooth 6*a* of manual control element 3.

When the control cam 11 has been moved a sufficient distance away from the manual control element 3, the pins 20 clear completely the orifices 21, as shown in FIG. 6, and at the same time the beak 17 of arm 18 is released completely, the corresponding switch being moved to its position enabling it to control the fast rotation of the programme-cams. Thus, the radial face 11*b* of cam 11 now in its second axial operative position is urged against the tips of pins 20 as a consequence of the radial component of the force exerted by springs 27, and an axial reaction toward the manual control element 3 is exerted on ramp means 24.

In this example, as illustrated in FIG. 6, the manual control element 3, having already moved through an angle of 5 degrees, will move through one additional degree for completing the commenced six-degree step, the spring loaded pawl 7 dropping into the next tooth hollow 6*c* of manual control element 3. Thus, this control element 3 has reached the angular position corresponding to the selected programme.

Figure 7:
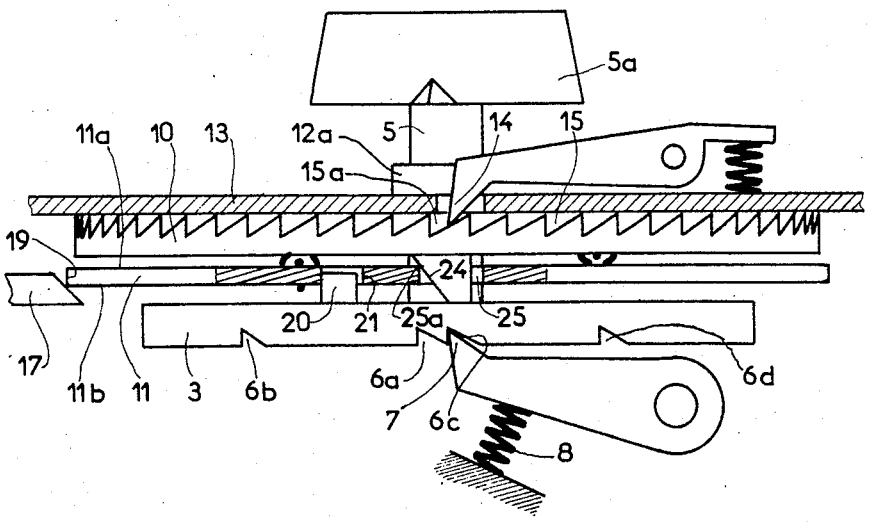
Figure 8:
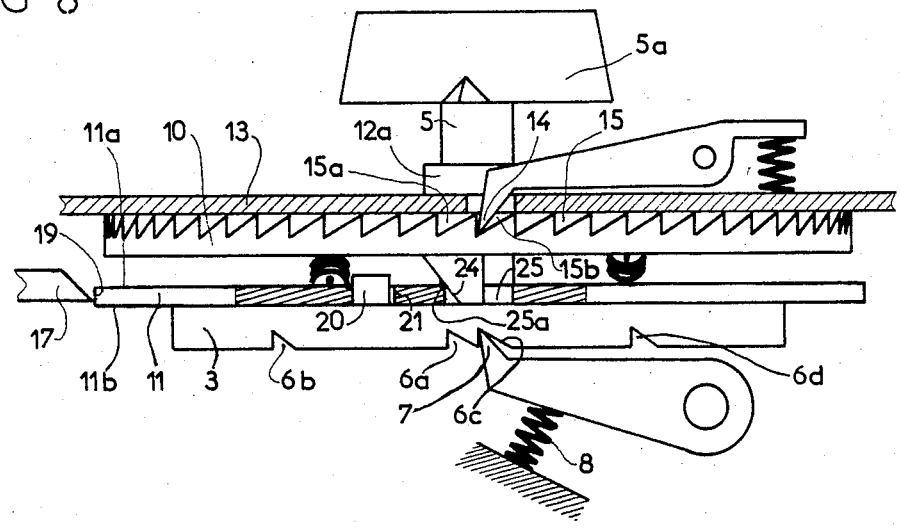

Then the operator actuates the general switch of the machine to be started, this switch being connected in series with the switch actuated by arm 18, so that the fast step by step rotation of the programme-cams 1 will begin. The disc 10 rotating in the direction of the arrow 4 with the programme-cams 1, causes the control cam 11 to rotate in the same direction, the ramp means 24 of this cam 11 being still pressed against the tips of pins 20. In this example, after a fast rotation of only one degree, the orifices 21 of control cam 11 are aligned with the corresponding pins 20. As shown in FIG. 7, the orifices 21 firstly begin to engage the pins 20, then the ramp means 24 push back by means of the bearing faces 25*a* the control cam 11 which is thus moved axially to its first position. The preceding additional stressing of springs 27 assists this movement. At the same time, the second positioning pawl 14 begins to be pushed back by the side face of tooth 15*a* of disc 10. The effort exerted by pawl 7 on tooth 6*c* is sufficient to prevent the forward rotation (in the direction of the arrow 4) of manual control element 3 during the last portion of the fast rotation of disc 10 and programme-cams 1 which is necessary for restoring the control cam 11 to its first axial inoperative position. This fast rotation of disc 10 ends with a five-degree movement while the control cam 11 is moved back by the ramps means 24.

Finally, while control cam 11 completes its movement causing the beak 17 to actuate the corresponding switch in order to stop the fast rotation of disc 10 and programmecams 1, the control cam 11 is restored to its initial inoperative position and the second pawl 14 drops into the next tooth hollow 15*b* of disc 10. Now all the component elements of the device are in the positions shown in FIG. 8. The angular position of programme-cams 1 and disc 10 corresponds to the angular position selected by means of the manual control element 3.

Subsequently, the programme-cams 1 are actuated automatically and step by step at a low rate throughout the unfolding of the selected programme. At the same time, the ramp means 24 tend to keep the control cam 11 pressed against the manual control element 3 and the same ramp means cause the rotation at the same rate and automatically of control cam 11 and through the pins 20 of manual control element 3.

The first form of embodiment (FIGS. 1–8) is characterized by an additional feature since the hub 12 rigid with the programme-cams 1 but not with the manual control element 3 is adapted to carry externally of the programme various mechanisms intended for controlling for example dispensers of lye-base products or display devices.

Figure 9:
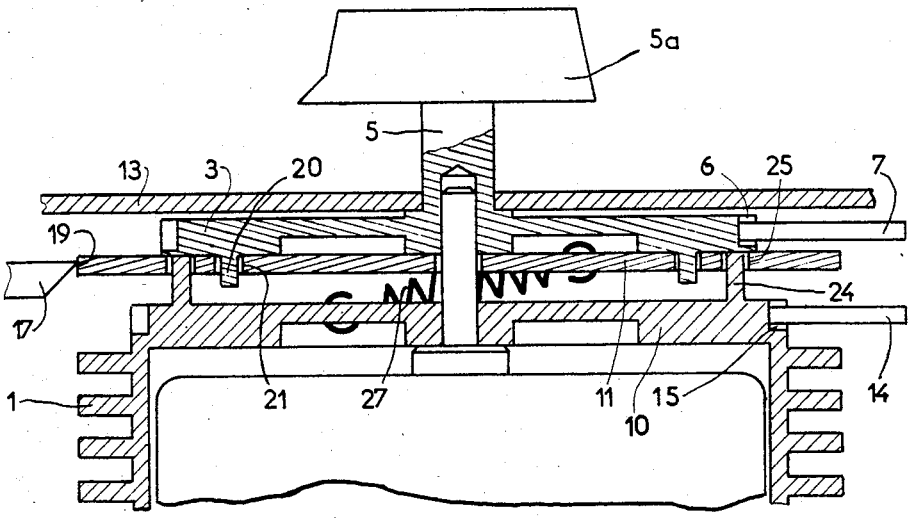
FIG. 9 is a fragmentary view similar to FIG. 1 showing a modified version of the first form of embodiment.

In a modified version of the first form of embodiment, illustrated in FIG. 9, the disc 10 is not moved away from the programme-cams 1 but in contrast thereto this disc 10 is pressed directly against the cams 1 so as to constitute a unitary structure therewith. The control cam 11 is still disposed between the disc 10 and the manual control element 3 bearing directly against the fixed supporting plate 13. The hub 12-12*a* is dispensed with and consequently cannot be used as in FIGS. 1–8 for supporting miscellaneous mechanisms externally of the programmer. All the other component elements are unchanged with respect to those of the first form of embodiment (FIGS. 1–8) and the assembly operates exactly in the same manner as described hereinabove.

Figure 10:
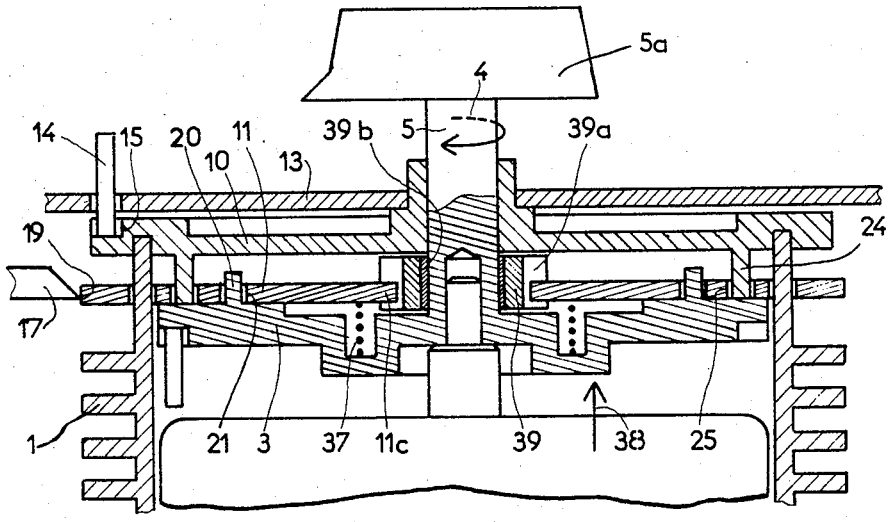
FIG. 10 is another fragmentary view similar to FIG. 1 showing a second modified form of embodiment.

The second form of embodiment is illustrated in FIG. 10 with its control cam 11 in its first inoperative axial position. The traction springs 27 are replaced by a coil compression spring 37 exerting only an axial resilient pressure in the direction of the arrow 38 which tends to move the control cam 11 towards the disc 10 and away from the manual control element 3. The control cam 11, though free to move in the axial direction, is responsive to brake means tending to prevent its rotation. This brake means may consist for example of a socket 39 surrounding with the interposition of friction means 39*b* the shaft 5 of control element 3, the control cam 11 comprising internal teeth 11*c* in constant meshing engagement with external teeth 39*a* formed on the outer periphery of socket 39 to permit the axial movement of control cam 11 while preventing this cam from rotating about its socket. All the other component elements are identical with those of the first form of embodiment described hereinabove with reference to FIGS. 1–8.

This second form of embodiment operates like the first form of embodiment. When the control cam 11 is actuated manually in the forward direction corresponding to the arrow 4 in relation to disc 10, by using the manual control element 3, this control cam 11 tending to move away from this manual control element 3 and towards the disc 10, due to the presence of coil spring 37. Thus, the cam 11 can actuate with its constant profile 19 the beak 17 of arm 18 controlling the fast rotation of disc 10.

When the pins 20 are retracted from orifices 21 the control cam 11 is held against rotation by friction means 39*b* and also against axial movement in its second position due to the axial play provided by construction between the tips of pins 20 and disc 10.

When the disc 10 is driven automatically for forward rotation in the direction of the arrow 4 with respect to control cam 11, this cam 11 held against rotation by its friction means 39*b* tends to be moved by the ramp means 24 against the force of spring 37, for abutment firstly against the tips of pins 20 and then, when the orifices 21 and pins 20 are again in mutual alignment, against the manual control element proper, so as to resume eventually its first inoperative axial position.

The remaining part of the operation is identical with that of the first form of embodiment (FIGS. 1–8).

The above-described forms of embodiment (FIGS. 1–10) have an additional advantageous feature. In fact, for manually selecting the desired programme, the operator must overcome essentially the resistance of the spring-loaded pawl 7, the control cam 11 urged by traction springs 27 or 37 alone following through its bearing faces 25*a* the contour of ramp means 24, the fast-rotation control switch being actuated by releasing the beak 17 of arm 18. All the relatively most important efforts are then exerted automatically, notably the backward movement of control cam 11 to its first position, while stressing the springs 27 or 37, by pushing back the beak 17 of arm 18 and the corresponding switch, and also by actuating the second positioning pawl 14.

Figure 11:
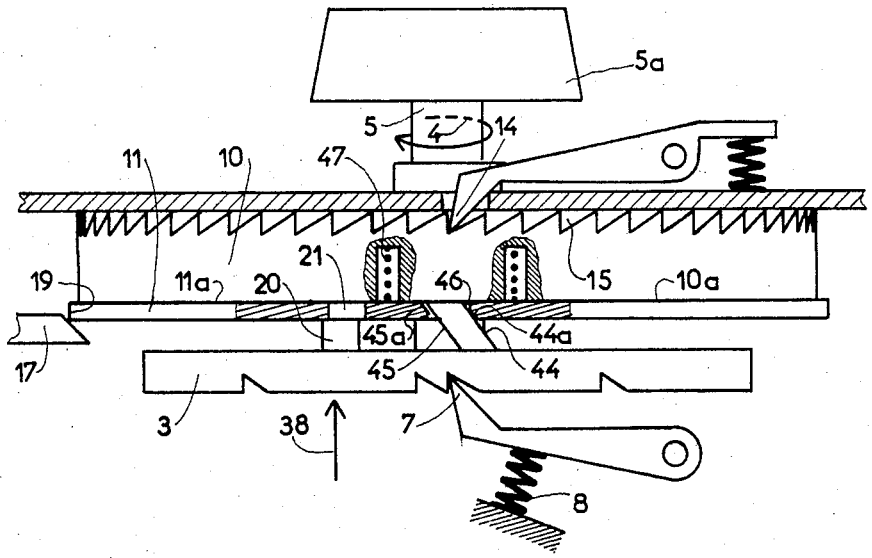
FIG. 11 is a fragmentary view similar to FIG. 6 showing a third form of embodiment of the invention.

In the third form of embodiment illustrated in FIG. 11, the cams 24 and their bearing faces 25*a* of the preceding forms of embodiment are dispensed with the replaced for example by two possibly substantially parallel first cams 44 and two second cams 45, formed on the radial face 10*a* of disc 10. These cams 44,45 are engageable by bearing faces 44*a*,45*a*, respectively, consisting of the two opposite ends of orifices 46 formed through the registering radial face 11*a* of control cam 11. At least one resilient means consisting for example of a coil compression spring 47 constantly urges the control cam 11 axially towards the manual control cam 3 away from disc 10. All the other component elements of the device are identical with those of the first form of embodiment (FIGS. 1–8).

This modified form of embodiment (FIG. 11) operates in a manner similar to that of the preceding forms of embodiment. When control cam 11 is rotated manually in the forward direction (see arrow 4) in relation to disc 10, the first ramp means 44 and their corresponding and respective bearing faces 44*a* are so oriented and shaped that this cam 11 tends to move away from the manual control element 3, and towards the disc 10, against the resistance of spring 47. On the other hand, the second ramp means 45 opposite the first ramp means 44 and the corresponding bearing faces 45*a* are so oriented and shaped that, when the disc 10 is subsequently driven automatically for rotation in the direction of the arrow 4 in relation to control cam 11, this control cam tends to move towards the manual control element 3. When the orifices 21 and the pins 20 are manually aligned, the spring 47 causes the pins to engage the corresponding orifices 21.

Otherwise, the mode of operation is the same as that of the first form of embodiment (FIGS. 1–8).

A fourth form of embodiment (not shown in the drawings) is very similar to the third form of embodiment. The spring 47 of this third form of embodiment (FIG. 11) is dispensed with and replaced by brake means to which the control cam 11 is responsive. This brake means is identical with the one previously described with reference to FIG. 10 and comprises the socket 39 fitted with the interposition of friction means 39*b* on shaft 5, and teeth 39*a* meshing with internal teeth 11*c*. All the other component elements are identical with those of the third form of embodiment (FIG. 11).

The mode of operation of this fourth form of embodiment differs from that of the preceding one only by the fact that when the disc 10 is driven automatically for rotation it is the braking action exerted on control cam 11 that enables the orifices 21 of this cam to be engaged by the corresponding pins 20.

Without departing from the basic principle of the present invention, the ramp means 24 or 44,45 could also be formed on control cam 11, and the bearing faces 25*a*, or 44*a*, 45*a* respectively, could be provided on disc 10. Similarly, the pins 20 could be formed on control cam 11, and the corresponding orifices 21 could be formed through the manual control element 3. The operation would remain unchanged.

With the above-described programme, it is possible to select the desired programme manually, for example from the STOP position at the end of the programme, during the unfolding of the programme, therefore during the slow rotation of programme-cams 1. The assembly operates in the same manner.

On the other hand, if the operator stops the manual rotation of control element 3 before attaining the angular position corresponding to the programme he wished to select, this manual control element will be driven automatically at a fast rate, until the next selecting position is reached, in which the positioning pawl 7 drops into the hollow of the corresponding tooth 6. The manual control element 3 is thus held against rotation and the assembly can operate as described hereinabove.

What is claimed is:

1. A programmer, which comprises:

a plurality of rotatable programme cams, each programme cam corresponding to a programme, each programme cam having an initial starting point of rotation spaced angularly from the initial starting point of rotation of any other of the programme cams, each programme cam being adapted to be rotatably driven automatically for a step-by-step rotation;

a manually rotatable control element for selecting the initial starting point of rotation of any one of the programme cams, the control element including a plurality of teeth, each tooth corresponding to a predetermined programme selection position;

a rotatable control cam having opposite first and second axial sides, the control cam being disposed coaxially to the control element with the first axial side of the control cam adjacent to the control element, and being adapted to cooperate with the control element;

means for axially shifting the control cam with respect to the control element between a first position and a second position;

switch means for controlling the automatically driven rotation of the programme cams, the switch means being actuated by the control cam when said control cam is in the second position, the control cam having a constant profile throughout the periphery thereof to actuate the switch means irrespective of the angular position of the control cam;

means for automatically and rotatably driving the control element through the control cam, the driving means being operative when the control cam is in the second position;

a disc secured to the programme cams and rotatable therewith and disposed coaxially to said control cam and adjacent to the second side thereof for causing the control cam to shift axially between the first position and the second position; and a spring biased positioning pawl cooperating with the teeth provided on the control element, the pawl exerting a force on the teeth sufficient to prevent the rotation of the control element in at least a first rotational direction during the automatically driven rotation of the disc and programme cams;

one of the control element and the control cam having at least one pin extending laterally therefrom, and the other of the control element and the control cam having formed therein at least one transverse orifice dimensioned to receive the at least one pin when the control cam is in the first position;

the disc and the control element being in spaced apart relationship and defining a gap therebetween, the gap having a width sufficient to allow the control cam to move from the first position, wherein the at least one pin is received by the at least one transverse orifice, to the second position, wherein the at least one pin is not received by the at least one transverse orifice.

2. A programmer as defined by claim 1, which further comprises resilient means exerting a force on the control cam and on the disc and constantly urging the control cam in a rotational direction that is opposite to the first direction and for shifting the control cam axially towards the disc by axially moving the disc away from the control element; and wherein one of the disc and control cam has formed thereon at least one ramp means, and the other of the disc and control cam has formed thereon at least one bearing face, the at least one ramp means and the at least one bearing face being oriented and shaped so that they cooperatingly bear against one another in response to the force exerted on the control cam and disc by the resilient means and help move the control cam towards the control element to the first position.

3. A programmer as defined by claim 1, which further comprises resilient means for constantly urging said control cam in an axial direction towards the disc and away from said control element; and brake means operatively coupled to the control cam for exerting a counter-rotational force on the control cam; and wherein one of the disc and the control cam has formed thereon at least one ramp means, and the other of the disc and control cam has formed thereon at least one bearing face, the at least one ramp means and the at least one bearing face being oriented and shaped so that they cooperatingly bear against one another and cause the control cam to move axially away from the control element when the control cam is manually rotated in the first direction, and causes the control cam to move axially towards the control element when the disc is automatically driven rotatably in the first direction.

4. A programmer as defined by claim 1, which further comprises resilient means for constantly urging the control cam axially towards the control element and away from the disc; and wherein one of the disc and control cam has formed thereon at least one ramp means, and the other of the disc and control cam has formed thereon at least one bearing face, the at least one ramp means and the at least one bearing face being oriented and shaped so that they cooperatingly bear against one another and cause the control cam to move axially away from the control element and towards the disc when the control cam is manually rotated in the first direction, and cause the control cam to move axially towards the control element when the disc is automatically driven rotatably in the first direction.

5. A programmer as defined by claim 1, which further comprises brake means operatively coupled to the control cam for exerting a counter-rotational force on the control cam; and wherein one of the disc and the control cam has formed thereon at least first and second ramp means, and the other of the disc and the control cam has formed thereon at least first and second bearing faces, the first ramp means and the first bearing face being oriented and shaped so that they cooperatingly bear against one another and cause the control cam to move axially away from the control element and towards the disc when the control cam is manually rotated in the first direction, and the second ramp means and the second bearing face being oriented and shaped so that they cooperatingly bear against one another and cause the control cam to move axially towards the control element when the disc is automatically driven rotatably in the first direction.

6. A programmer as defined by claim 1, which further comprises an external control shaft axially mounted to the control element, and a tubular socket surrounding the external control shaft and mounted to the disc; and wherein the disc is spaced axially from the programme cams to define a gap therebetween, the gap having a width sufficient to allow the control cam and control element to be interposed between the disc and the programme cams and to allow the control cam to move axially between the control element and the disc between the first position and the second position.

* * * * *